United States Patent [19]

Wosenitz

[11] Patent Number: 4,936,218

[45] Date of Patent: Jun. 26, 1990

[54] PROJECTILE

[76] Inventor: William B. Wosenitz, 341 NE. 2nd Ct., Dania, Fla. 33004

[21] Appl. No.: 420,134

[22] Filed: Oct. 10, 1989

[51] Int. Cl.[5] ..... F42B 10/34

[52] U.S. Cl. ..... 102/503; 244/3.23

[58] Field of Search ..... 102/439, 501, 503; 244/3.23

[56] References Cited

U.S. PATENT DOCUMENTS

| | | | |
|---|---|---|---|
| 14,742 | 4/1856 | Smith | 244/3.23 |
| 33,746 | 11/1861 | Matteson | 102/503 |
| 1,103,740 | 7/1914 | Cooper . | |
| 1,327,531 | 1/1920 | Durham | 102/503 |
| 2,941,469 | 6/1960 | Barnhart | 244/3.23 |
| 3,200,751 | 8/1965 | Vitt | 102/92.5 |
| 4,164,904 | 8/1979 | Laviolette | 102/92.7 |
| 4,258,625 | 3/1981 | Black | 102/92.1 |
| 4,301,736 | 11/1981 | Flatau et al. | 102/503 |
| 4,627,357 | 12/1986 | Gobis | 102/503 |
| 4,776,281 | 3/1987 | Chiang et al. | 102/532 |
| 4,805,535 | 2/1989 | Marcon | 102/503 |
| 4,827,847 | 5/1989 | Laviolette et al. | 102/503 |

FOREIGN PATENT DOCUMENTS

| | | | |
|---|---|---|---|
| 6923 | 1/1896 | Sweden | 102/503 |
| 134896 | 11/1919 | United Kingdom | 102/503 |

OTHER PUBLICATIONS

Article on "Airgun Pellets" describing hourglass shape, p. 23.

Handloader Article (Mar.-Apr. 1985) describing various 12 gauge slug loads, p. 39.

Ballistic Products Inc. Catalog #59.

Ballistic Products, Inc. Brochure 1983 "Slug and Buckshot Manual", see p. 9.

*Primary Examiner*—Harold J. Tudor

*Attorney, Agent, or Firm*—Oltman and Flynn

[57] ABSTRACT

A tubular projectile having a venturi throat configuration is disposed with rifling on the interior wall surfaces providing a highly aerodynamic projectile which can be used in smooth bore barrel artillery.

4 Claims, 2 Drawing Sheets

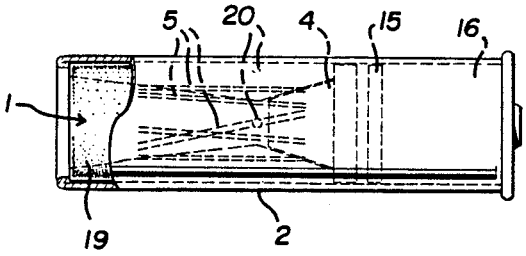
FIG. 1
FIG. 3
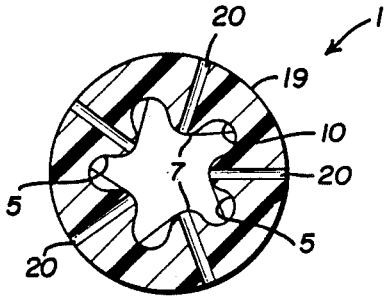
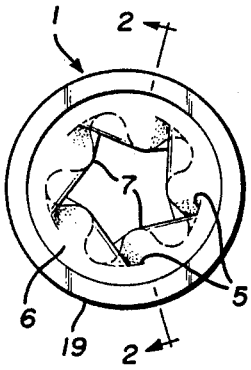
FIG. 4
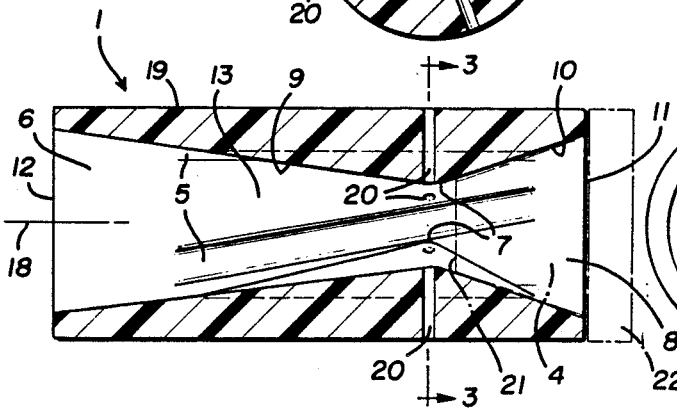
FIG. 2
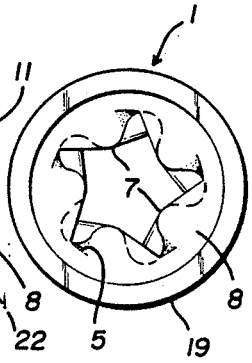
FIG. 5
FIG. 6
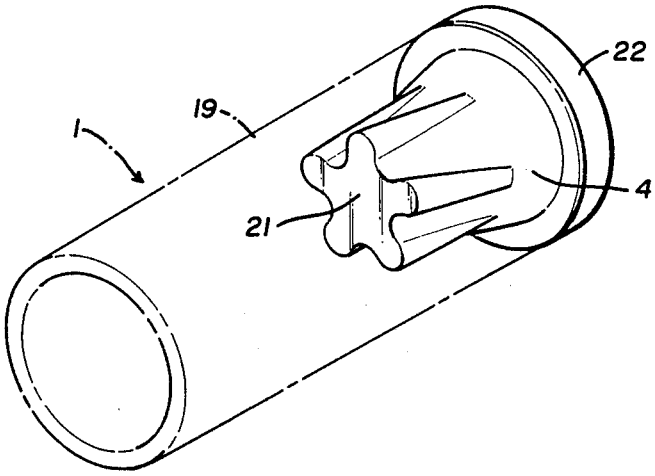

FIG. 8
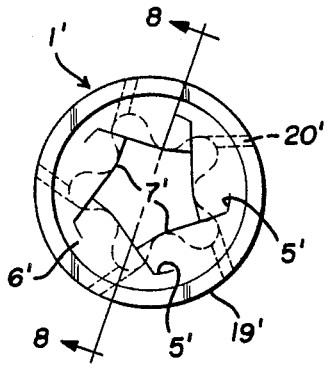
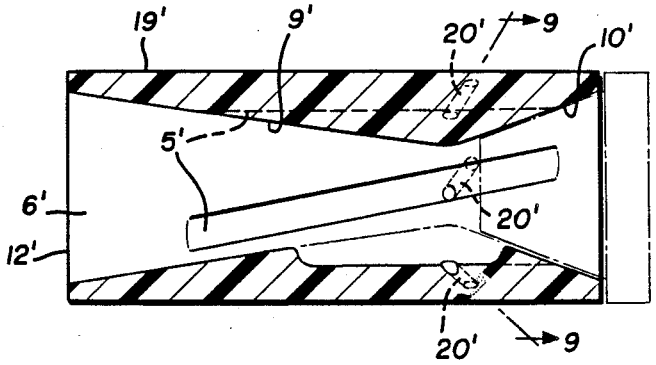
FIG. 7
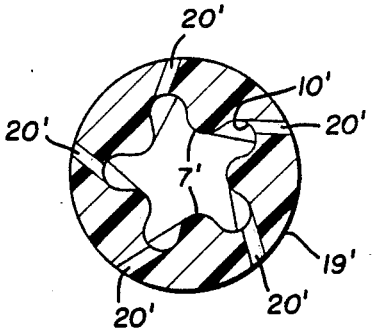
FIG. 9

PROJECTILE

BACKGROUND OF THE INVENTION

1. Field of the Invention

This invention relates generally to projectiles and more particularly to rifled bullets for use in smooth bore gun barrels.

2. Description of the Prior Art

There has been an increased interest in recent years in the use of slugs especially for the hunting of large game animals. Conventional slugs known in the art tend to consist of a solid mass of lead with a relatively blunt nose and generally cylindrical body. These solid lead slugs were optionally equipped with helical ribbing disposed about the outer periphery of the slug. The incorporation of the helical ribbing (rifling) imparts a spin to the projectile while in flight and creates a generally more aerodynamic slug. However, many hunters have complained that even with the outer rifling these solid lead slugs were inaccurate, had a short effective range and lacked knockdown power. Furthermore, these rifled slugs could not be utilized in a traditional smooth bore barrel shotgun as they would cause undue wear and leading to the inner barrel surface and accuracy and gyration would both be significantly impaired.

Attempts have been made to overcome these problems of the prior art by manufacturing projectiles from lighter weight materials or alternately providing a hollow center passage through the projectile such as to form a tubular shape. The tubular projectile has especially proven to possess certain advantages over previous projectile designs as the tubular passage significantly reduces ballistic drag and shock wave and increases impact force and target penetration. The tubular projectile can optionally be provided with the outer helical rifling to impart a gyration on the airborne projectile. Variations in the size and shape of the hollow center passage have been demonstrated such as expanding the size of the inlet area aperture and providing thicker passage walls with varying success rates. It has been therefore concluded that minor changes of contour can make a decisive difference in the success or failure of the design in terms of its ballistic and aerodynamic characteristics. A particularly desirable design has proven to consist of a hollow passage wherein the inner surface gradually tapers inwardly converging toward a throat section immediately followed by a divergent aft section. The incorporation of the throat section has been shown to optimize many of the critical ballistic characteristics. However, when rifling is included on the exterior surface of this throated slug, its use in smooth bore shotguns is questionable.

A longfelt need has therefore existed in the prior art for the development of an extremely accurate tubular slug for use in a smooth bore barrel shotgun which still intrinsically spins during flight producing gyroscopic stabilization.

SUMMARY OF THE INVENTION

The present invention employs a throated tubular projectile wherein helical rifling is provided on the inner surface walls such that it can be loaded in a smooth bore barrel shotgun without compromising ideal aerodynamic characteristics. Thus, the novel provision of helical rifling on the interior projectile walls induces rotation of the slug identical to the rotation effects of exterior rifling. The hollow design forces airflow to enter the center passage of the slug as the slug travels through the air; the forceful flow of air over the helical grooves inherently causes the slug to rotate producing superior aerodynamic effects. Stability is further enhanced with the incorporation of a venturi throat passage shape. The air inlet aperture is at a maximum diameter thereby permitting the greatest possible volume of air into the interior of the slug. The interior walls then converge rearwardly, approximately ¾ the length of the projectile, to a point of minimum diameter, then immediately diverge outwardly at approximately the same pitch as convergence, climaxing at the exit aperture such that the exit aperture possesses a diameter which is substantially larger than the minimum point (venture throat point), but does not surpass the cross-sectional area of the air inlet aperture. The provision of the venturi type throat design reduces pressure as the air must compress to achieve the minimum cross-sectional area, thereby stabilizing the flight of the bullet and reducing drag, bases vacuum and shock wave or head pressure. The slug might optionally be provided with a plurality of small radial holes from the venturi throat to the outer surface of the slug. These radial holes minimize turbulence of the air passing through the throated passageway, and prevent chocking above mach 4 thus further stabilizing the flight of the projectile. These holes may be at a trailing compound angle to the axis so that they help to impart spin to the slug, or they may be perpendicular to the axis.

It is the combination a venturi throat, interior rifling and optional radial holes which define a superior tubular projectile for use in a smooth bore barrel shotgun.

Accordingly it is an important object of the present invention to provide an improved projectile for use in a smooth bore barrel.

A further object of the present invention is to provide the novel use of rifling on the interior walls of a projectile.

Another object of the present invention is to provide a combination of several separate features to effectively maximize aerodynamic characteristics and reduce ballistic drag, and shock wave or head pressure.

Further objects and advantages of this invention will be apparent from the following detailed description of a presently preferred embodiment which is illustrated schematically in the accompanying drawings.

BRIEF DESCRIPTION OF THE DRAWINGS

FIG. 1 is a longitudinal sectional view showing the novel tubular projectile in place within a shell casing;

FIG. 2 is an enlarged longitudinal sectional view of the tubular projectile in accordance with a first embodiment of the present invention;

FIG. 3 is a cross-sectional view of the projectile taken along line 3—3 of FIG. 2.

FIG. 4 is a front end view looking down the longitudinal axis of the projectile;

FIG. 5 is a rear end view looking down the longitudinal axis of the projectile.

FIG. 6 is a perspective view of the pusher disposed within a shell casing.

FIG. 7 is a front end view of a projectile in accordance with a second embodiment of this invention.

FIG. 8 is a longitudinal section taken along the line 8—8 in FIG. 7.

FIG. 9 is a cross-section taken along the line 9—9 in FIG. 8.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION OF THE DRAWINGS

Referring now in detail to FIG. 1, a projectile is illustrated generally at 1. As shown, projectile 1 is disposed within a conventional shell casing 2 and is oriented flush against a nylon pusher 4. The pusher 4, best shown in FIG. 6, preferably has either a triangular, pentagonal, hexagonal or a conical diameter (frustum of cone) terminal end 21 which contacts the projectile 1 when oriented in a typical arrangement. The pusher 4 further contains a flange member 22 which acts as a support that prevents deformation. The shotgun acts as a solid barrier thereby allowing the projectile 1 to eject from the casing 2 and out the terminal end of the gun barrel (not shown). For 383 PCC or 357 MAG in a rifled barrel a gas check 15 may be incorporated into the pusher or may be part of the wad or a separate item to establish proper wad column height for crimping, allowing for clean firing and increased projectile velocity. The powder chamber 16 is behind the gas check.

FIG. 2 shows the projectile 1 in greater detail. the inventive structure is an elongate tubular body member with a center hollow passage 13 extending therethrough and is symmetrical about a center longitudinal axis 18. The outer surface 19 of the body member is essentially smooth and may optionally contain a plurality of radial holes 20 which penetrate completely through the body member, effectively extending from the outer surface 19 to the inner surface walls 9, 10. The radial holes 20 minimize turbulence of the air flowing through the hollow passage 13 and prevent chocking when the projectile 1 is in flight. The holes 20 may be oriented either perpendicular to the center axis 18, as shown in FIGS. 2 and 3, or they may be at a compound angle to the center axis, as shown at 20' in FIGS. 8 and 9, to complement spin. The projectile 1 is comprised of two sections 6,8 intersected by a single plane throat 7 of minimum diameter. The forward inner surface walls 9, initiating at the air inlet aperture 12, converge rearwardly until reaching the throat 7, thereby defining the forward compression section 6. After attaining the point of minimum diameter 7, the rear inner surface walls 10 begin to diverge outwardly at approximately the same pitch as convergence until reaching the exit aperture 11. The rear divergence section 8 is thereby defined with the throat 7 and the exit aperture 11 as its confining limits.

This projectile design drastically reduces drag, shock wave and turbulence and allows for maximized velocity levels. After launch from the gun muzzle, air enters the projectile 1 through the air inlet aperture 12. The air immediately becomes compressed due to the converging inner wall surfaces 9; upon reaching the sharp edged throat 7, the air will be instantaneously forced to diffuse outwardly while traveling through the rear divergence section 8 such that an essentially steady state flow condition is achieved as the air evacuates the projectile 1 through the exit aperture 11. It will blow away the pusher and wads. Any turbulence generated from successive compression and diffusion of the air will be significantly circumvented by the incorporation of the radial holes 20 on the body member's outer surface 19. The end result includes an extremely effective projectile 1 whereby the venturi type throat design stabilizes the direction and velocity of the projectile 1 as it is in flight, thereby increasing the external ballistics by significantly depreciating drag.

The inner wall surfaces 9,10 are disposed with 12–14 flutes of high thin helical ribbing known as rifling 5. The rifling 5 may be oriented on both inner wall surfaces 9,10 or in a second embodiment, only the forward inner surface walls 9 are provided with rifling 5. As air enters the center passage 13, the rifling 5 acts to force the air flow in a circular direction causing a gyration or spinning of the projectile 1 as it is in flight. The rotating action of the projectile 1 creates a more stable slug and improves its inherent accuracy.

FIGS. 7, 8 and 9 show a second embodiment of the invention which is identical to the embodiment of FIGS. 2–6 except that it has transverse holes 20' extending from the periphery 19' of the hollow body into the throat 7' of its venturi passageway at a compound angle to the axis of this passageway instead of perpendicular to it.

The projectile and pusher of the instant invention may be packaged in any conventional shotgun shell or other encasing known in the art. It is anticipated that the projectile is particularly well adapted for use in a smooth bore barrel gun and especially a shotgun or smooth bore artillery.

The projectile may be made of metal such as lead or high density thermoplastic or polymers. The latter have superior wear resistance, dimentional stability and low cost per cubic inch. When fired into hard wax, a lead projectile will double its diameter. When fired into aluminum or steel it will punch out a plug and then form a ball and go through.

I claim:

1. A projectile for use in a gun having a smooth bore gum barrel, said projectile comprising an elongated hollow body having a cylindrical periphery, an axially extending venturi passageway therethrough with an entrance aperture at one end of said body, an exit aperture at the opposite end of said body, a venturi throat located between and spaced from said entrance and exit apertures, a converging section extending from said entrance aperture to said throat and of gradually smaller diameter toward said throat, and a diverging section extending from said throat to said exit aperture and of gradually larger diameter away from said throat, a plurality of circumferentially spaced helical ribs in said venturi passageway extending a substantial distance along said converging section to said throat, through said throat, and a substantial distance along said diverging section, and a plurality of transverse holes extending from said throat of said venturi passageway laterally out to said periphery of said body at intervals circumferentially of said hollow body to reduce turbulence.

2. A projectile according to claim 1 wherein said transverse holes are spaced apart circumferentially at substantially equal intervals at said throat of the venturi passageway and at substantially equal intervals on said periphery of said body.

3. A projectile according to claim 2 wherein each of said holes extends substantially radially of the axis of said venturi passageway.

4. A projectile according to claim 2 wherein each of said holes extends at a compound angle to the axis of said venturi passageway.

* * * * *